US006935046B2

(12) United States Patent
Tang et al.

(10) Patent No.: US 6,935,046 B2
(45) Date of Patent: Aug. 30, 2005

(54) SWIVEL CORD HAIR DRYER

(75) Inventors: Raymond Tang, Hong Kong (HK); Michael Cafaro, El Paso, TX (US)

(73) Assignee: Helen of Troy L.P., El Paso, TX (US)

( * ) Notice: Subject to any disclaimer, the term of this patent is extended or adjusted under 35 U.S.C. 154(b) by 31 days.

(21) Appl. No.: 10/441,935

(22) Filed: May 20, 2003

(65) Prior Publication Data

US 2004/0231180 A1 Nov. 25, 2004

(51) Int. Cl.[7] ..... A45D 20/10
(52) U.S. Cl. ..... 34/97; 34/96; 439/13; 439/28
(58) Field of Search ..... 439/13, 18, 28, 439/19; 34/96, 97

(56) References Cited

U.S. PATENT DOCUMENTS

| | | | | | |
|---|---|---|---|---|---|
| 3,866,995 | A | | 2/1975 | Campo | 339/8 R |
| 3,937,543 | A | * | 2/1976 | Tomaro | 439/21 |
| 3,950,052 | A | | 4/1976 | Walter et al. | 339/8 R |
| 3,957,331 | A | | 5/1976 | Tantillo et al. | 339/6 R |
| 3,981,314 | A | | 9/1976 | Barradas | 132/9 |
| 4,003,616 | A | | 1/1977 | Springer | 339/8 R |
| 4,557,536 | A | | 12/1985 | Geurts | 339/8 P |
| 4,965,693 | A | | 10/1990 | Aoki | 361/42 |
| 5,419,707 | A | * | 5/1995 | Kelley | 439/21 |
| 5,425,645 | A | | 6/1995 | Skovdal et al. | 439/23 |
| 6,011,903 | A | * | 1/2000 | Nosenchuck | 392/385 |

* cited by examiner

*Primary Examiner*—Henry Bennett
*Assistant Examiner*—Kathryn S. O'Malley
(74) *Attorney, Agent, or Firm*—Vinson & Elkins L.L.P.

(57) ABSTRACT

A durable and maneuverable hand-held or small home appliance having a swivel structure attached at the end handle of the appliance to permit the electrical cord to pivot about the handle of the appliance. Further contemplated by the present disclosure is a swivel structure that permits for an electrical cord having at least about 180 degrees of rotation about a pivot point and operable at elevated wattage levels.

37 Claims, 3 Drawing Sheets

SWIVEL CORD HAIR DRYER

BACKGROUND OF THE INVENTION

1. Field of Invention

The present invention relates to an electrical appliance having a maneuverable and rotatable cord attached to the handle of the appliance. More particularly, the present invention relates to a hair care appliance, for example a hair dryer, having a maneuverable cord, connected to the end of the handle, and wherein the cord rotates or swivels freely about the connection.

2. Description of Related Art

The hair dryer is one of the most useful appliances in hairdressing. Hair dryers serve at least two primary functions. One function is to dry wet hair and the other is to facilitate hair styling. As more and more consumer attention is focused on the art of hair design and the growing hairdressing field, so too has consumer attention increased in hair design implements, such as the new dryer.

Current hair care appliance designs have an end handle portion of the appliance that is rigidly fixed to the electrical cord. During operation, the hair care appliance is moved at varying angles and/or directions to facilitate grooming or styling. This angular, or twisting, movement often results in the formation of knots, tangles, and kinks along the electrical cord. Such knotting results in several disadvantages. One is that the life of the appliance is reduced due to stress on the electrical cord which causes the interior copper wires to bend and break. Further, the maneuverability of the appliance is decreased as the cord becomes knotted. The angular movements along the electrical cord also applies force to the plug thereby loosening the connection and resulting in an unstable electrical supply. Accordingly, the operational efficiency of the hair care appliance is reduced. In addition, typical devices having moveable cords to minimize stress incur a tremendous amount of sparking or arcing when elevated wattage levels are employed.

Therefore, it would be an advantage in the art of personal care appliances to provide for an electrical appliance, for example a hair dryer, having an electrical cord that rotates freely at the base of the appliance handle, to minimize, if not completely eliminate, the twisting, knotting and kinking of the electrical cord that typically occurs during operation of the appliance. In addition, it would be a further advantage to provide for an appliance that minimizes stress to the electrical cord while at the same time, utilizes elevated wattage levels.

SUMMARY OF THE INVENTION

In one aspect of the present invention, a durable personal care appliance is contemplated where that appliance has an end handle having a swivel structure such that the electrical cord attached to the end handle spins, rotates, pivots or otherwise twirls about the base of the handle to prevent twisting of the cord during use by a hair stylist.

Another aspect of the present invention contemplates a maneuverable hair dryer having a normal hair dryer unit where the distal end of the normal hair dryer unit connects to an electrical cord via a connector having a swivel structure.

Yet another aspect of the present invention involves a swivel structure fixed with a round staircase-shaped base the end handle consisting of a protruding edge and a groove. The top of the base is linked with the outside electrical cord by the first contacting plate and the other contacting plate of the base. On the inside of the hair dryer unit there is the base supporter located at the top of the base which connects with the inside lead cord by an electrical contact and contact plate which are located inside of the base supporter. In between the base supporter and the base is a spring, one end of the spring is connected with the base and the other end is connected with an electrical contact, the other electrical contact is connected with the first contacting plate and the contacting plate of the base.

A further aspect of the present invention is that the swivel structure allows for the electrical cord to rotate about the handle of the appliance about 180 degrees.

An even further aspect of the present invention involves the use of the disclosed swivel structure on a hand-held or other small movable appliance and wherein the wattage levels are elevated, that is, greater than about 1000 watts.

One embodiment of the present invention contemplates an electrical appliance having a handle portion with a terminal end, a swivel structure attached to the terminal end of the handle portion, an internal lead cord comprising a first lead cord wire and a second lead cord wire and an external electrical cord extending from the handle portion and comprising a first external wire and a second external wire, wherein the external electrical cord is attached to the swivel structure. The swivel structure preferably comprises a base, a base support attached to the base and rotatable with respect to the base, a first electrical contact attached to the base support configured to electrically connect to the first lead cord wire, a second electrical contact attached to the base support configured to electrically connect to the second lead cord wire, a first contact plate electrically connected to the first external wire, a second contact plate electrically connected to the second external wire, an insulating structure separating the first contact plate from the second contact plate, a first spring disposed between the base support and the first contact plate, wherein the first spring urges contact with the first contact plate and a second spring disposed between the base support and the second contact plate, wherein the second spring urges contact against the second contact plate.

Typical insulating structures will be appreciated by those of ordinary skill in the art and may include plastic, rubber, fiber glass sleeving, heat shrink tubing, electrical tape, KAPTON or other thermoplastic, heat tape, and the like. Also, within the context of this disclosure, the term spring is intended to include any structures and/or materials which when compressed exert a force to enable contact between the electrical contacts and contacting plates of the present invention. For example structures such as a spiral spring, a coil spring, a linear spring, a leaf spring, and the like or compression materials such as foam, sponge, elastic, rubber, plastic and the like, may be employed.

Another feature of the embodiments disclosed herein is that the appliance preferably utilizes greater than about 1000 watts of power, more preferably greater than about 1250 watts of power, and most preferably greater than about 1875 watts of power, perhaps even more.

Additionally, it is preferable for the first and second contacting plates to be annular. It is also preferable for the base to be a round staircase-shaped base although, any design that allows for the interlocking of components, here the base and the base support, is contemplated herein and will be appreciated by those of ordinary skill within the art.

Another optional feature of the embodiments disclosed herein are that the appliance is hand-held, for example, it may be a personal care appliance such as a hair dryer, it may be a kitchen appliance such as a blender, power tool such as a drill, it may be a household appliance such as a lamp or vacuum cleaner, and it may also be a garden appliance such as a lawn mower.

Another embodiment of the electrical appliance comprises a handle with a substantially cylindrical hollow end portion terminating in an annular protruding edge, a substantially cylindrical base comprising an internal portion, an external portion, and a groove separating the internal portion and the external portion, wherein the base is attached to the handle during use by insertion of the protruding edge of the handle into the groove and further wherein the base is rotatable with respect to the handle when attached. The internal portion of the cylindrical base comprises two annular contact plates electrically isolated from each other and wherein each contact plate comprises an electrical connector for an electrical wire of an external cord. Further, the base support member, disposed in the handle, comprises two electrically isolated electrical connections for an internal cord and two flexible electrical leads each connecting one of the electrical connections for an internal cord to one of the annular contact plates on the base. In addition, the appliance comprises two springs, one disposed between each contact plate and the base support member and each of the respective flexible electrical leads are disposed between separate contact plates and a respective spring. An additional optional feature consists of providing an insulating structure to separate the two contact plates. An additional optional feature of the present embodiment includes two additional springs, disposed between each contact plate and the base support, and positioned to urge contact between the electrical contacts and the contacting plates of the present invention.

A further embodiment includes an apparatus comprising a hair dryer unit that utilizes at least about 1000 watts of power, the hair dryer unit having a handle portion, a swivel structure to connect an external electrical cord to an internal electrical lead cord of the hair dryer, where the swivel structure is connected to rotate about the handle portion of the dryer unit, and wherein the degree of rotation about said handle is at least about 180 degrees. In addition, the swivel structure further comprises a base, having a first contacting plate, a base support fitted to the base, where the base support has two electrical contacts and second contacting plate, where the one of two electrical contacts are connected to the second contacting plate. Further, the swivel structure has a first spring connected to the base and a second spring connected to the second of two electrical contacts.

Also included within the scope of the claimed invention is an apparatus for joining an electrical cord to an electrical appliance, where the appliance utilizes at least about 1000 watts or power, preferably more, and the apparatus comprising a swivel structure that connects the electrical cord to the electrical appliance. The swivel structure preferably comprises a base, a base support, attached to the base and rotatable with respect to the base, a first electrical contact attached to the base support configured to electrically connect to the first lead cord wire, a second electrical contact attached to the base support configured to electrically connect to the second lead cord wire, a first contact plate electrically connected to the first external wire, a second contact plate electrically connected to the second external wire, an insulating structure separating the first contact plate from the second contact plate, a first spring disposed between the base support and the first contact plate, wherein the first spring urges the first electrical contact against the first contact plate and a second spring disposed between the base support and the second contact plate, wherein the second spring urges the second electrical contact against the second contact plate.

Also contemplated herein is a hair dryer that comprises a body and a rotatable base, where the base comprises annular electrical contacts that are electrically connected to an external cord and where the internal electrical leads are connected to the annular electrical contacts.

Similarly, a method for connecting an appliance to an electrical cord is an embodiment of the present disclosure. Such method comprises the steps of providing an electrical cord and appliance and connecting the electrical cord to the appliance through a swivel structure. The preferred swivel structure comprises a base, a base support attached to the base and rotatable with respect to the base, a first electrical contact attached to the base support configured to electrically connect to the first lead cord wire, a second electrical contact attached to the base support configured to electrically connect to the second lead cord wire, a first contact plate electrically connected to the first external wire, a second contact plate electrically connected to the second external wire, an insulating structure separating the first contact plate from the second contact plate, a first and third spring disposed between the base support and the first contact plate, wherein the first and third springs urge the first electrical contact against the first contact plate and a second and fourth spring disposed between the base support and the second contact plate, wherein the second and fourth springs urge the second electrical contact against the second contact plate.

DETAILED DESCRIPTION OF THE INVENTION

While the making and use of various embodiments of the present invention are discussed here in terms of an apparatus it should be appreciated that the present invention provides many inventive concepts that can be embodied in a wide variety of specific contexts. The specific embodiments discussed herein are merely illustrative of specific ways to make and use the invention and are not meant to limit the invention in any way. Accordingly, for ease of discussion, a hair dryer embodiment is described below, as an exemplary appliance, and the description of the hair dryer embodiment is not intended to limit the invention.

Figure 1:
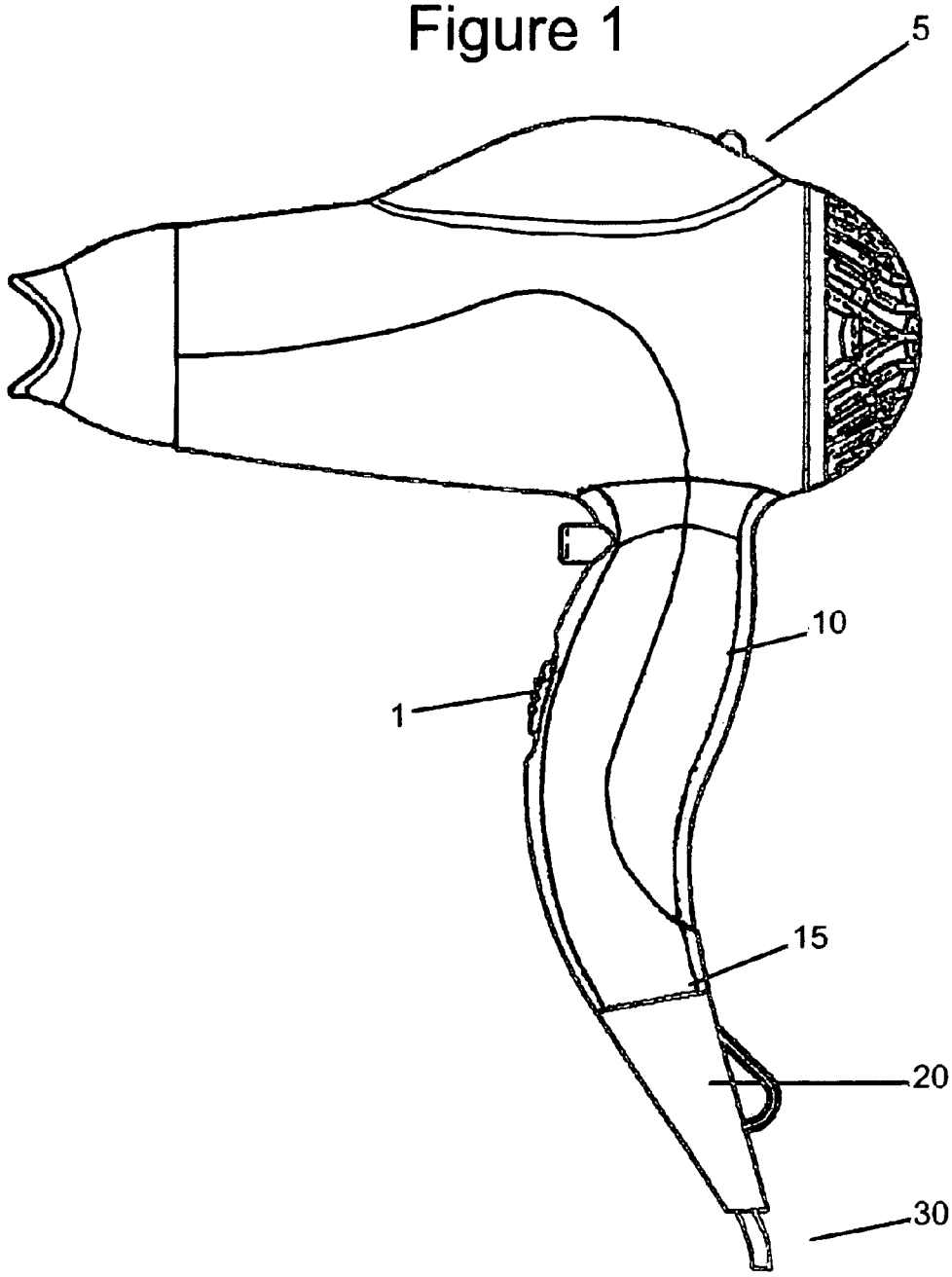
FIG. 1 depicts the hair dryer embodiment of the present invention.

FIG. 1 of the drawings is a conventional hair dryer unit (5), with an on/off switch (1). The hair dryer unit (5) has a handle portion (10) with a terminal end (15) that is connected to an electrical cord (30), via a swivel structure (not shown) (40), that is housed within the swivel casing (20).

Figure 2:
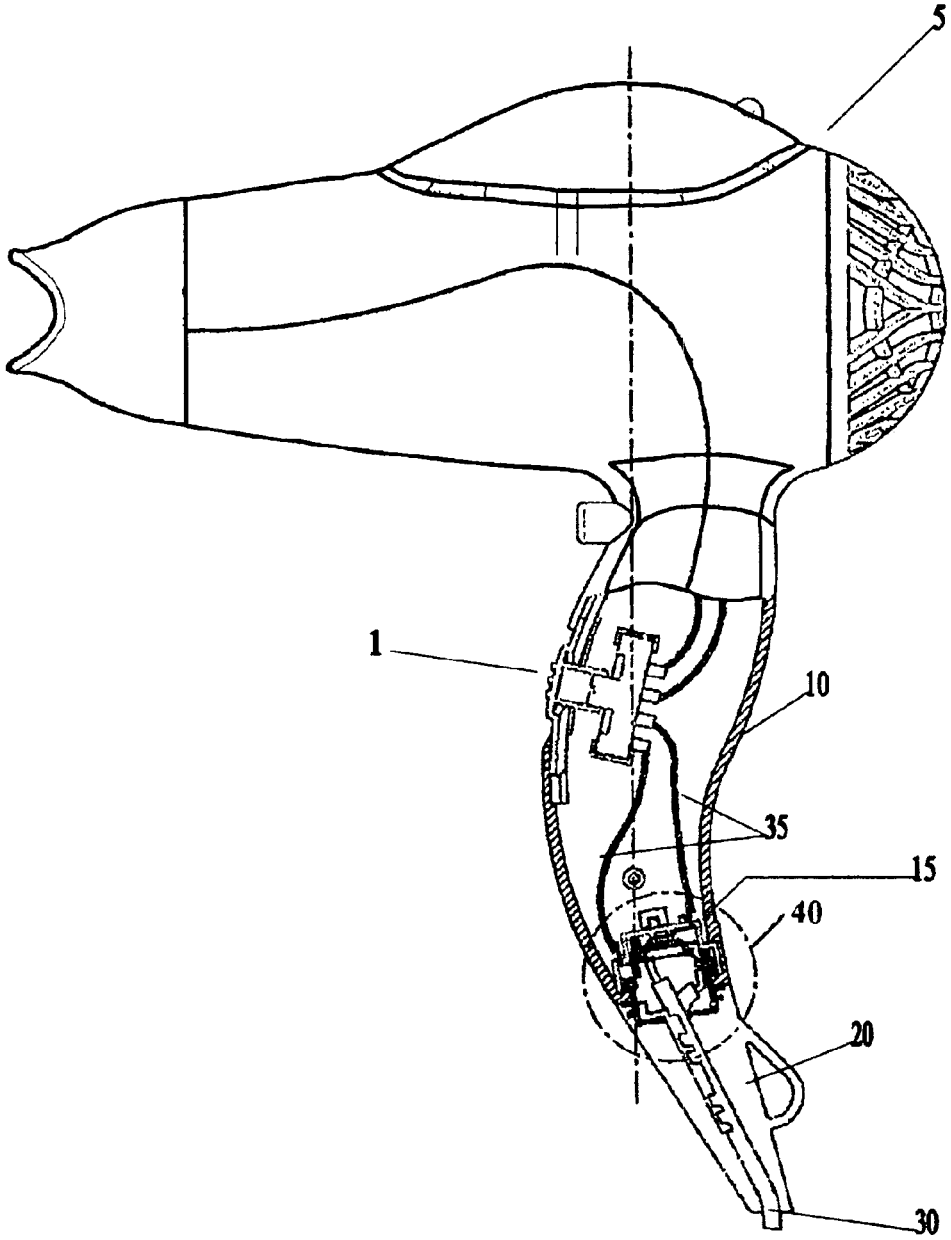
FIG. 2 illustrates a cross-sectional view the hair dryer embodiment of the present invention.

FIG. 2 of the drawings is a cross-sectional view of the conventional hair dryer unit (5) to further illustrate the swivel structure (40) that is housed within the swivel casing (20).

Figure 3:
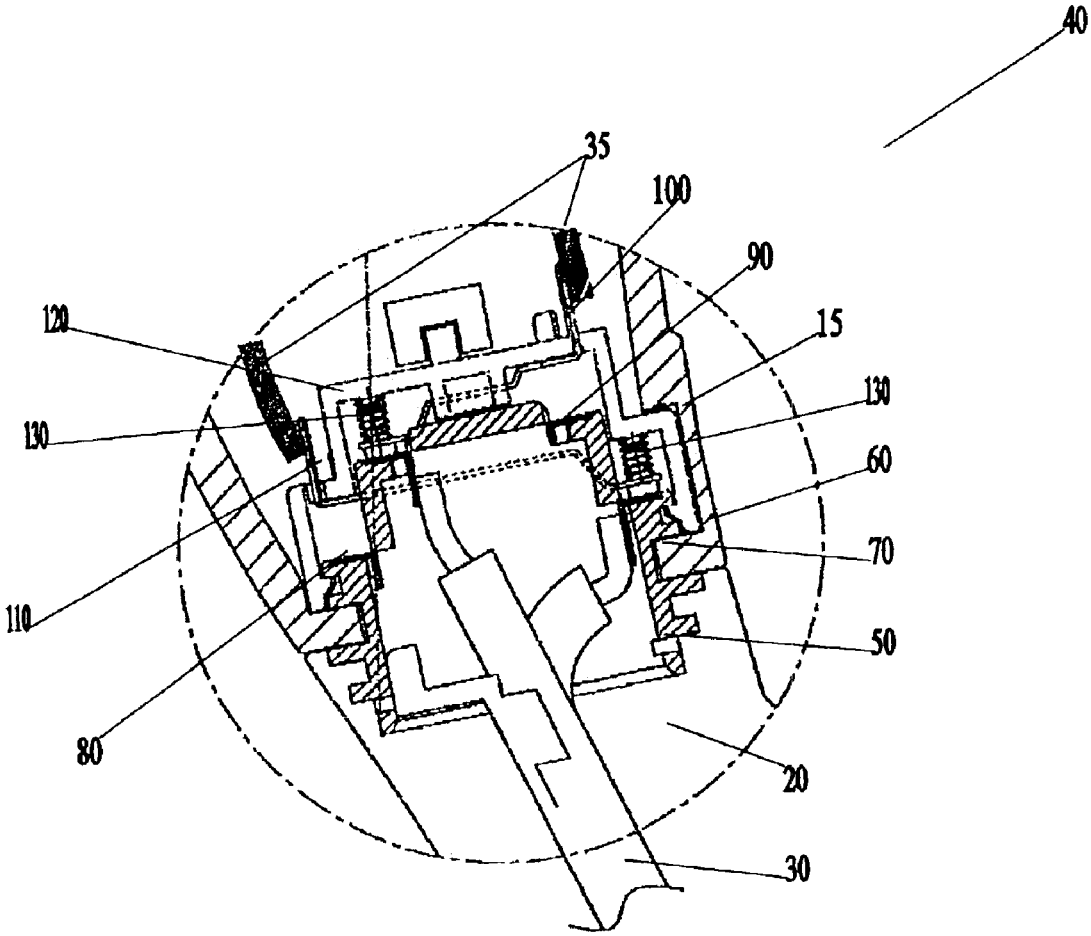
FIG. 3 shows an enlarged and cross-sectional view of the swivel structure as embodied in a hair dryer embodiment.

FIG. 3, is an enlarged, cross-sectional depiction of the swivel structure (40). The swivel structure (40) is equipped with a base (50), preferably a round staircase-shaped spring base. The terminal end (15) of the hair dryer unit (5) consists of a protruding edge (70) and a groove (60), such that the base (50) may be joined to the dryer unit. While it is preferable to utilize a round staircase-shaped spring base, as the base (50), in combination with the protruding edge (70) and the groove (60) to join the hair dryer unit (5) to the swivel structure (40), alternate interlocking features may be employed and are contemplated herein. When joined, the electrical cord (30) is linked to the first contacting plate (90) and the second contacting plate (80). These contacting plates, (80) and (90), are preferably composed of a conductive material, most preferably copper.

The swivel structure (40) preferably consists of a base support (120) located at the top of the base (50), connecting the inside lead cord (35) to an electrical contact (100) and another contact (110) which are affixed to the base support (120). Located in between the base support (120) and the base (50) is at least one spring (130). Preferably one spring (130) is configured to urge contact between the electrical contact (100) and the first contacting plate (90). The second spring (130) is configured to urge contact between other electrical contact (110) and the second contacting plate (80). Preferably, the swivel structure (40) includes a spring (130) composed of a spiral spring, preferably, at least two springs or spiral springs are employed, more preferably two or more spiral springs, most preferably four spiral springs, and perhaps even more. While a spiral spring is especially preferred, any structure or material to urge contact between the electrical contacts and the contacting plates may be employed.

The swivel structure (40), consisting of the swivel equipments (50–130), is fixed with the base support (120) to the terminal end (15) of the hair dryer unit (5) located inside of the protruding edge (70) and groove (60). The swivel structure (40) connects the electrical cord (30) by the electrical contact of the base (100) and electrical contact of swivel structure (110) which are fixed with the base support (120). One embodiment includes a base (50), preferably a round staircase-shaped base, and a base support (120) positioned on top of the base (50) to connect the inside lead cords (35) and contacting plates of the base (90) to the contacting plates of the swivel structure (80). In between the base support (120) and the base (50) is a spring (130). The spring (130) is located inside the base (50) at one end and the other end of the spring (130) is fixed with the electrical contact (100). The other electrical contact (110) is connected with contacting plates of the base (90) and the contacting plates of the swivel structure (80). The base (50), in one embodiment, is a round post-shaped structure and having different diameter size contacting plates (90) and the other contacting plates (80) fixed together with the round shaped base (50) at the same surface. The spring (130) is preferably a spiral spring, although other known spring-like structures or materials that when compressed exert a force sufficient to enable contact between the electrical contacts (100 and 110) and the contact plates (80 and 90), may be employed, such as a coil spring, a linear spring, a leaf spring, or materials such as foam, sponge, elastic, rubber, plastic and the like. The electrical contact (100) and the other electrical contact (110), in one embodiment, are in staircase-shaped structures.

During styling, when the user is rotating and moving the hair dryer unit(s), the spring (130), inside the base (50), and the other end of the spring (130) is set with the first electrical contact (100), the second electrical contact (110) is fixed with the rotating contacting plates of the swivel structure (90) and the rotating contacting plates of the base (80) together as one structure. Therefore, the inside lead cords (35) and the electrical cord (30) are connected together and the electrical cord (30) can pass through the swivel structure (40) of the base support (120). A further embodiment of the present invention allows for an appliance having a swivel structure (40) to permit the electrical cord (30) to rotate freely about the handle portion (10) of the hair dryer unit (5). It is preferable for the range of rotation to be greater than about 180 degrees, more preferably greater than about 270 degrees and most preferably greater than about 360 degrees.

And yet a further embodiment of the present invention contemplates an appliance having a swivel structure (40) capable of operation at elevated wattage levels, preferably grater than about 1000 watts, more preferably greater than about 1250 watts, most preferably greater than about 1875 watts and perhaps even greater.

The foregoing description of an exemplary embodiment is for illustrative purposes only and is not intended to limit the scope of the claimed invention. Indeed, various modifications and applications of the described invention are intended to be within the scope of the present invention. In addition to the hair dryer embodiment described above, other personal care applications such as, a curling iron, flat iron, diffuser, shaver, trimmers, clippers and the like are contemplated by the present disclosure. Also, applications outside the personal care field, preferably involving hand-held or other small transitory appliances, are within the scope of the present disclosure. For example, kitchen appliances, such as blenders, can-openers, mixers, food processors and the like; power tools such as drills, sanders, saws, routers, nailers, and the like; household appliances such as lamps, vacuum cleaners, buffers, telephones, fans, and the like; or gardening appliances such as lawn mowers, weed trimmers, hedge trimmers and the like; are likewise contemplated by present disclosure.

What is claimed is:

1. An electrical appliance comprising:

a handle portion having a terminal end;

a swivel structure attached to the terminal end of the handle portion;

an internal lead cord comprising a first lead cord wire and a second lead cord wire; and an external electrical cord extending from the handle portion and comprising a first external wire and a second external wire, wherein the external electrical cord is attached to the swivel structure;

wherein the swivel structure comprises:

a base;

a base support attached to the base and rotatable with respect to the base;

a first electrical contact attached to the base support configured to electrically connect to the first lead cord wire;

a second electrical contact attached to the base support configured to electrically connect to the second lead cord wire;

a first contact plate electrically connected to the first external wire;

a second contact plate electrically connected to the second external wire;

an insulating structure separating the first contact plate from the second contact plate;

a first spring disposed between the base support and the first contact plate, wherein the first spring urges the first electrical contact against the first contact plate; and a second spring disposed between the base support and the second contact plate, wherein the second spring urges the second electrical contact against the second contact plate.

2. The apparatus of claim 1 wherein said appliance utilizes at least about 1000 watts of power.

3. The apparatus of claim 1 wherein said appliance utilizes at least about 1250 watts of power.

4. The apparatus of claim 1 wherein said appliance utilizes at least about 1875 watts of power.

5. The apparatus of claim 1 wherein the first and second contact plates are annular.

6. The apparatus of claim 1 wherein the base is a round staircase-shaped base.

7. The apparatus of claim 1 wherein said appliance is hand-held.

8. The apparatus of claim 7 wherein said appliance is a hair dryer.

9. An electrical appliance comprising:

a handle comprising a substantially cylindrical hollow end portion terminating in an annular protruding edge;

a substantially cylindrical base comprising an internal portion, an external portion, and a groove separating the internal portion and the external portion, wherein the base is attached to the handle during use by insertion of the protruding edge of the handle into the groove and further wherein the base is rotatable with respect to the handle when attached;

wherein the internal portion comprises two annular contact plates electrically isolated from each other and wherein each contact plate comprises an electrical connector for an electrical wire of an external cord;

a base support member disposed in the handle comprising two electrically isolated electrical connections for an internal cord and two flexible electrical leads each connecting one of the electrical connections for an internal cord to one of the annular contact plates on the base; and a first and second spring, one disposed between each contact plate and the base support member and wherein the respective flexible electrical leads are disposed between separate contact plates and a respective spring.

10. The apparatus of claim 9 wherein said appliance utilizes at least about 1000 watts of power.

11. The apparatus of claim 9 wherein said appliance utilizes at least about 1250 watts of power.

12. The apparatus of claim 9 wherein said appliance utilizes at least about 1875 watts of power.

13. The apparatus of claim 9 wherein the base is a round staircase-shaped base.

14. The apparatus of claim 9 wherein the two contact plates are separated by an insulating structure.

15. The apparatus of claim 9 wherein said appliance is hand-held.

16. The apparatus of claim 15 wherein said appliance is a hair dryer.

17. The apparatus of claim 9 further comprising a third and fourth spring, disposed between each contacting plate and said base support.

18. An apparatus comprising:

a hair dryer unit that utilizes at least about 1000 watts of power, said hair dryer unit having a handle portion;

a swivel structure to connect an outside electrical cord to an inside lead cord of an appliance, said swivel structure is connected to rotate about said handle portion, and wherein the degree of rotation about said handle is least about 180 degrees, said swivel structure further comprising:

a base, having a first and second contacting plate;

a base support fitted to the base, said base support having two electrical contacts, wherein one of two electrical contacts is in contact with the first contacting plate;

one spring connected to the base; and a second spring connected to the second of two electrical contacts.

19. The apparatus of claim 18 further comprising a third and fourth spring.

20. An apparatus for joining an electrical cord to an electrical appliance, wherein said appliance utilizes at least about 1000 watts of power, said apparatus comprising a swivel structure, wherein said swivel structure is connected to rotate about a pivot point, wherein the swivel structure comprises:

a base;

a base support attached to the base and rotatable with respect to the base;

a first electrical contact attached to the base support configured to electrically connect to a first lead cord wire;

a second electrical contact attached to the base support configured to electrically connect to a second lead cord wire;

a first contact plate electrically connected to the first external wire;

a second contact plate electrically connected to the second external wire;

an insulating structure separating the first contact plate from the second contact plate;

a first spring disposed between the base support and the first contact plate, wherein the first spring urges the first electrical contact against the first contact plate; and a second spring disposed between the base support and the second contact plate, wherein the second spring urges the second electrical contact against the second contact plate.

21. The apparatus of claim 20 wherein said appliance utilizes at least about 1250 watts of power.

22. The apparatus of claim 20 wherein said appliance utilizes at least about 1875 watts of power.

23. The apparatus of claim 20 wherein the degree of rotation about said junction is greater than about 180 degrees.

24. The apparatus of claim 20 wherein the degree of rotation about said junction is greater that about 270 degrees.

25. The apparatus of claim 20 wherein the degree of rotation about said junction is greater than about 360 degrees.

26. The apparatus of claim 20 wherein the first and second contacting plates are annular.

27. The apparatus of claim 20 wherein the base is a round staircase-shaped base.

28. The apparatus of claim 20 wherein said appliance is hand-held.

29. The apparatus of claim 28 wherein said appliance is a hair dryer.

30. A hair dryer that comprises a body and a rotatable base, wherein the base comprises two annular electrical contacts that are electrically insulated from each other, and wherein the two annular electrical contacts are each separately electrically connected to one of two lead wires of an external cord and wherein two internal electrical leads are each held against one of the annular electrical contacts by one or more springs per each electrical lead.

31. The hair dryer of claim 30 wherein said appliance utilizes at least about 1000 watts of power.

32. The hair dryer of claim 30 wherein said appliance utilizes at least about 1250 watts of power.

33. The hair dryer of claim 30 wherein said appliance utilizes at least about 1875 watts of power.

34. The hair dryer of claim 30 wherein the degree of rotation about said junction is greater than about 180 degrees.

35. The hair dryer of claim 30 wherein the degree of rotation about said junction is greater that about 270 degrees.

36. The hair dryer of claim 30 wherein the degree of rotation about said junction is greater than about 360 degrees.

37. A method for connecting an appliance to an electrical cord comprising the steps of:

providing an electrical cord and appliance;

connecting the electrical cord to the appliance through a swivel structure;

said swivel structure comprising a base;

a base support attached to the base and rotatable with respect to the base;

a first electrical contact attached to the base support configured to electrically connect to a first lead cord wire;

a second electrical contact attached to the base support configured to electrically connect to a second lead cord wire;

a first contact plate electrically connected to the first external wire;

a second contact plate electrically connected to the second external wire;

an insulating structure separating the first contact plate from the second contact plate;

a first and third spring disposed between the base support and the first contact plate, wherein the first and third springs urge the first electrical contact against the first contact plate; and a second and fourth spring disposed between the base support and the second contact plate, wherein the second and fourth springs urge the second electrical contact against the second contact plate.

* * * * *